US012258752B2

(12) United States Patent
Magin et al.

(10) Patent No.: US 12,258,752 B2
(45) Date of Patent: Mar. 25, 2025

(54) ASYMMETRICAL BUILDING SURFACE BAFFLES AND BUILDING SURFACE SYSTEM

(71) Applicant: CertainTeed Ceilings Corporation, Malvern, PA (US)

(72) Inventors: Michael Magin, Cumming, GA (US); Samuel Carrillo Lacouture, Lawrenceville, GA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 592 days.

(21) Appl. No.: 17/555,843

(22) Filed: Dec. 20, 2021

(65) Prior Publication Data

US 2022/0195717 A1 Jun. 23, 2022

Related U.S. Application Data

(60) Provisional application No. 63/127,863, filed on Dec. 18, 2020.

(51) Int. Cl.
*E04B 1/34* (2006.01)
*E04B 1/344* (2006.01)
(Continued)

(52) U.S. Cl.
CPC ..... *E04B 1/344* (2013.01); *E04B 2/72* (2013.01); *E04B 1/994* (2013.01); *E04B 9/003* (2013.01)

(58) Field of Classification Search
CPC . E04B 1/344; E04B 2/72; E04B 1/994; E04B 9/003
See application file for complete search history.

(56) References Cited

U.S. PATENT DOCUMENTS 1,061,236 A * 6/1913 Fuller ..... A24F 13/26 30/113
8,701,362 B2 * 4/2014 Stone ..... E04D 3/08 52/204.5
(Continued)

FOREIGN PATENT DOCUMENTS

FR 1447307 A * 7/1966
JP 2002317519 A * 10/2002
(Continued)

OTHER PUBLICATIONS

Atelier Alain Ellouz (AAE), Private Residence—Alabaster Blinds webpage, downloaded Oct. 30, 2020.
Frasch, Canoe Baffl—Acoustical ceiling baffle webpage, downloaded Oct. 30, 2020.
Acrhiproducts, Addenda—acoustic baffles by Manade webpage, downloaded Oct. 30, 2020.
(Continued)

*Primary Examiner* — Babajide A Demuren
(74) *Attorney, Agent, or Firm* — McDonnell Boehnen Hulbert & Berghoff LLP

(57) ABSTRACT

The present disclosure relates generally to building surface baffles, for example, suitable for forming a room divider, a wall covering, an acoustical surface, or a ceiling surface. The present disclosure relates more particularly to a baffle for a building surface. The baffle includes an elongate body extending along an axis from a first end to a second end. The elongate body has a depth including a narrow portion that extends away from the axis along a first direction and a wide portion. The wide portion includes first and second projections that extend laterally outward from the first direction. The baffle also includes a first aperture extending into the first end of the elongate body along the axis and a second aperture extending into the second end of the elongate body along the axis.

19 Claims, 12 Drawing Sheets

(51) Int. Cl.

| | |
|---|---|
| ***E04B 2/72*** | (2006.01) |
| *E04B 1/99* | (2006.01) |
| *E04B 9/00* | (2006.01) |

(56) References Cited

U.S. PATENT DOCUMENTS

| | | | | |
|---|---|---|---|---|
| 10,619,692 | B2 * | 4/2020 | Tomita | F16J 15/3236 |
| 10,858,850 | B2 * | 12/2020 | Wheatley | E04G 23/0218 |
| 11,484,139 | B1 * | 11/2022 | Hagberg | F41A 23/18 |
| 2002/0124499 | A1 * | 9/2002 | Braybrook | E04B 2/96 52/235 |
| 2008/0236095 | A1 * | 10/2008 | Kim | E06B 3/5454 52/784.16 |

FOREIGN PATENT DOCUMENTS

| | | | | |
|---|---|---|---|---|
| JP | 2010043456 | A * | 2/2010 | |
| JP | 2014214582 | A * | 11/2014 | E04B 2/72 |

OTHER PUBLICATIONS

Turf, Wedge acoustic ceiling baffle webpage, downloaded Oct. 30, 2020.

Turf, Drop; acoustic ceiling baffle webpage, downloaded Oct. 30, 2020.

Alibaba.com, Manual operable adjustable shutters & sun shade & louvre webpage, downloaded Oct. 30, 2020.

Credence, Baffle Ceiling webpage, downloaded Oct. 30, 2020.

* cited by examiner

ASYMMETRICAL BUILDING SURFACE BAFFLES AND BUILDING SURFACE SYSTEM

CROSS REFERENCE TO RELATED APPLICATIONS

This application claims the benefit of priority of U.S. Provisional Patent Application No. 63/127,863, filed Dec. 18, 2020, which is hereby incorporated by reference in its entirety.

BACKGROUND OF THE DISCLOSURE

1. Field of the Disclosure

The present disclosure relates generally to building surface baffles, for example, suitable for forming a room divider, a wall covering, an acoustical surface, or a ceiling surface. The present disclosure relates more particularly to asymmetrical baffles for forming a building surface.

2. Technical Background

The use of baffles for forming a building surface is a popular alternative to typical building surfaces that are solid and continuous. In contrast to a wall or ceiling formed by drywall or plaster, the baffles can allow air and light through while still defining a particular space, such as a room. For example, baffles can be used as a divider to separate two rooms while allowing light and air to pass through. Similarly, a ceiling surface that is formed using baffles can allow air in the room to access heating and ventilation equipment while being obscured behind the baffles. Likewise, lights that are installed above the baffles can be combined with, or used in place of, lights below the baffles to provide various different lighting effects.

Most baffles have a standard planar shape and appear as a series of parallel boards or panels. This configuration and the standard baffle shape is effective for forming a surface while also allowing air and light through the surface. However, this standard shape and configuration provides limited aesthetic options, and many building surfaces formed by baffles are visually similar.

Further, existing ceiling baffle systems are typically supported by a ceiling grid, that holds the baffles in a specific configuration. In some cases the ceiling grid is visible, and impacts the aesthetic of the surface. Moreover, the ceiling grid can dictate the position and spacing of the baffles, which limits the variability of the aesthetic of the surface.

The present inventors have recognized that a baffle construction for a building surface that provides an alternative baffle shape without visible supporting components would be attractive to architects and builders.

SUMMARY OF THE DISCLOSURE

In one aspect, the present disclosure provides a baffle for a building surface, the baffle comprising:

an elongate body extending along an axis from a first end to a second end, the elongate body having a depth including a narrow portion that extends away from the axis along a first direction and a wide portion, the wide portion including first and second projections that extend laterally outward from the first direction;

a first aperture extending into the first end of the elongate body along the axis; and a second aperture extending into the second end of the elongate body along the axis.

In another aspect, the disclosure provides a building surface system comprising:

a first support structure;

a second support structure; and a plurality of baffles according to the disclosure extending from the first support structure to the second support structure, wherein each baffle is supported at the first end by a respective first pin segment that is inserted into the first aperture and is supported at the second end by respective second pin segment that is inserted into the second aperture.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional baffles used for building surfaces provide limited options for the surface aesthetic. The present inventors have noted that a baffle construction for a building surface that provides an alternative baffle shape without visible supporting components would be attractive to architects and builders.

Accordingly, one aspect of the disclosure is a baffle for a building surface. The baffle includes an elongate body extending along an axis from a first end to a second end. The elongate body has a depth including a narrow portion that extends away from the axis along a first direction and a wide portion. The wide portion includes first and second projections that extend laterally outward from the first direction. The baffle also includes a first aperture extending into the first end of the elongate body along the axis and a second aperture extending into the second end of the elongate body along the axis.

Figure 1A:
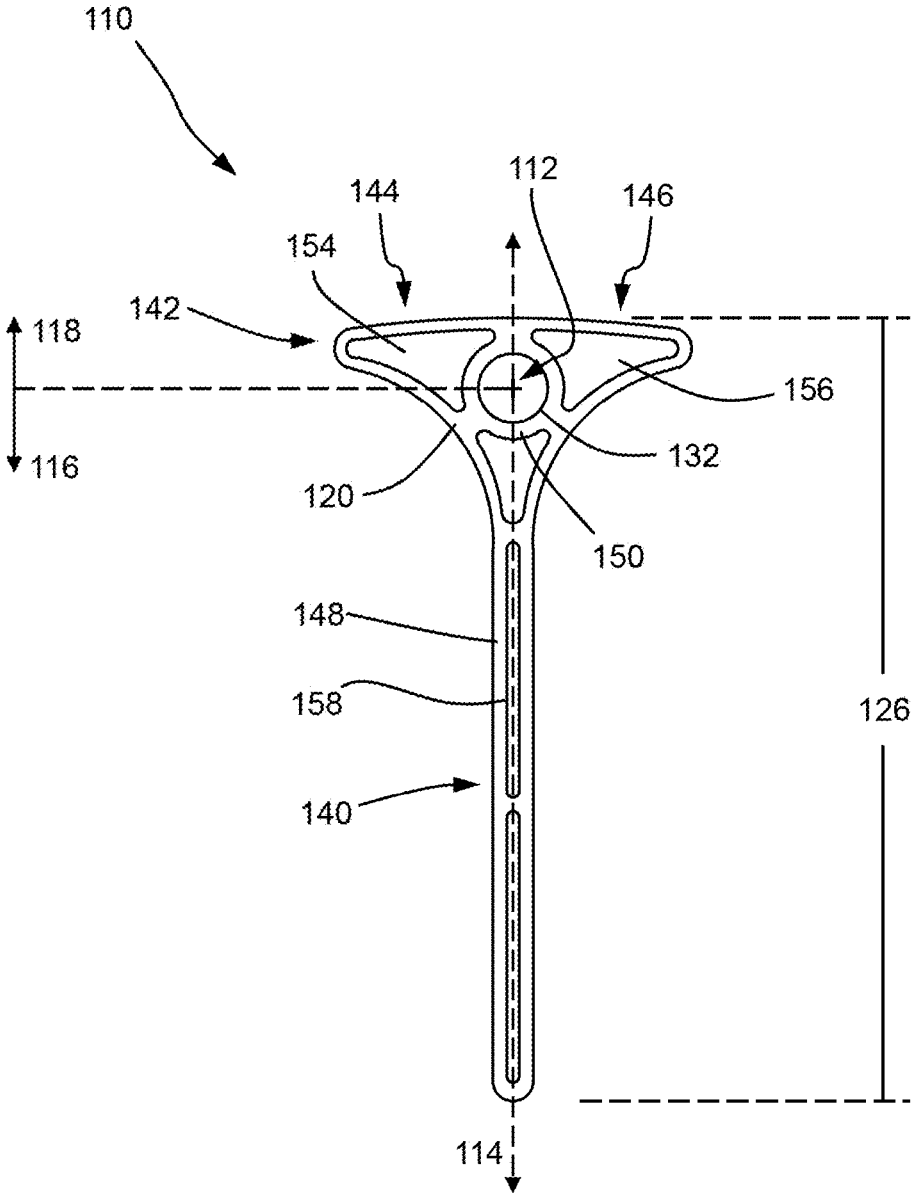
FIG. 1A is a schematic end view of a baffle according to an embodiment of the disclosure.
Figure 1B:
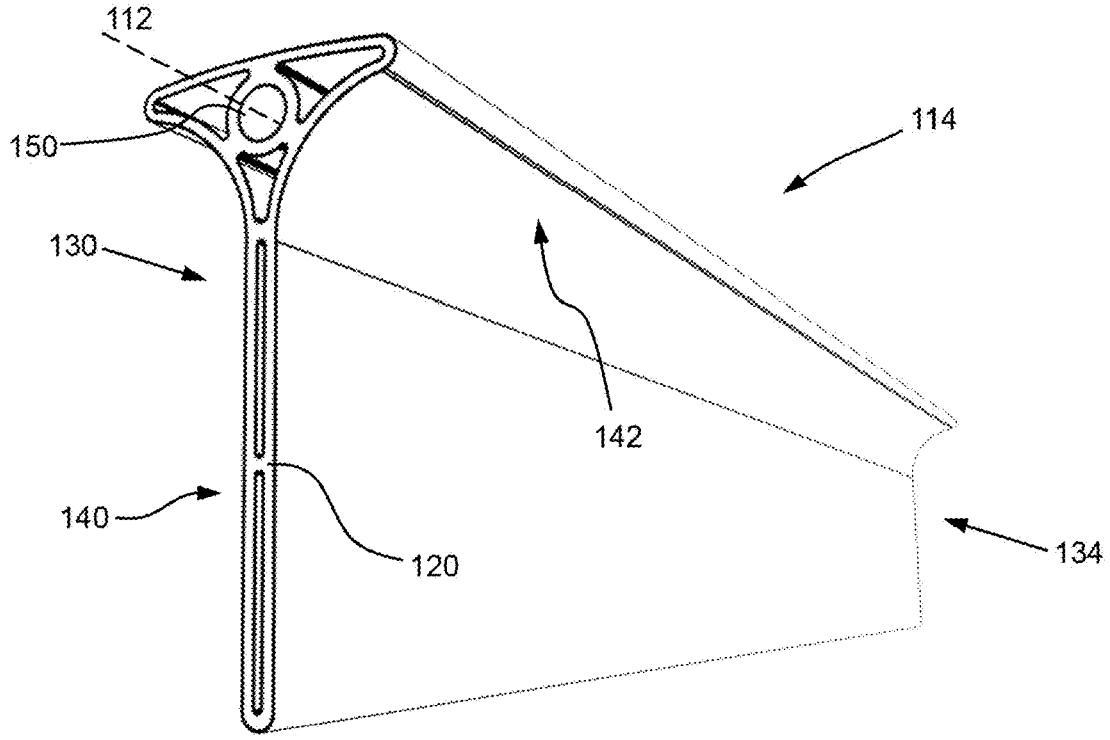
FIG. 1B is a schematic perspective view of the baffle of FIG. 1A.
Figure 1C:
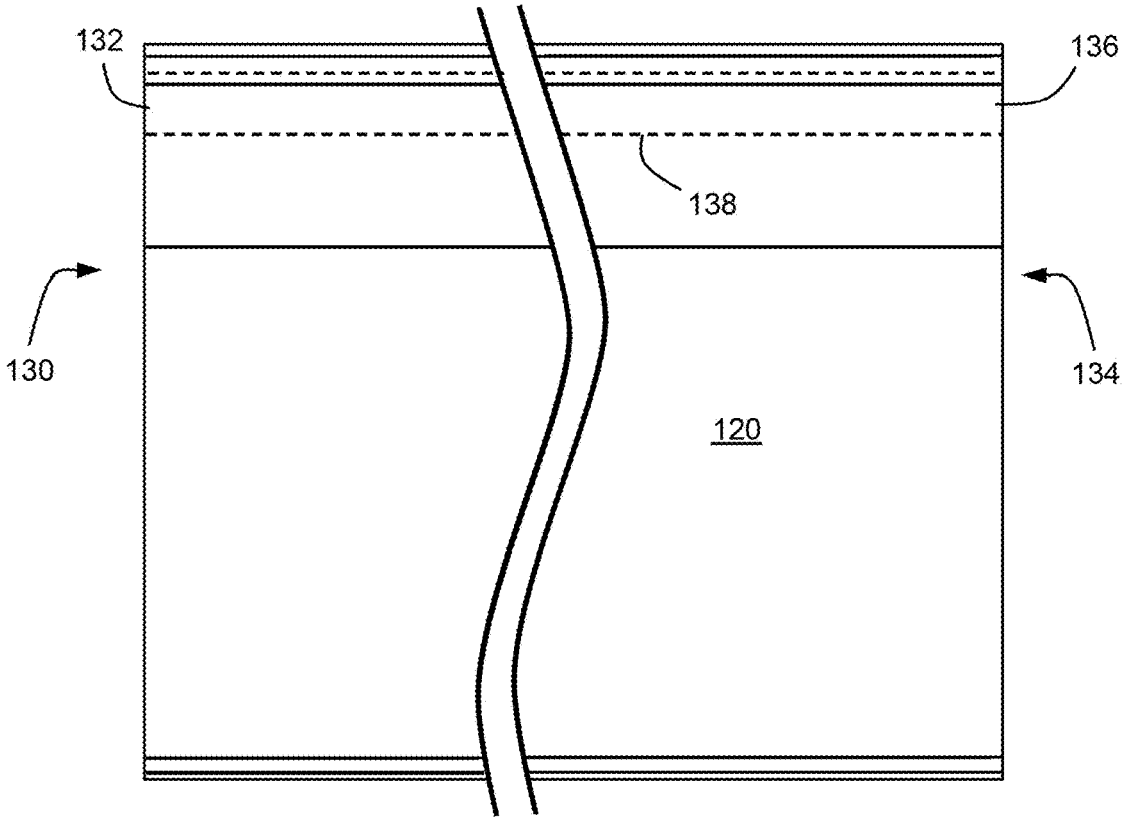
FIG. 1C is a schematic side view of the baffle of FIG. 1A.

Such a baffle is shown in FIGS. 1A to 1C, where FIG. 1A shows an end view, FIG. 1B shows a perspective view, and FIG. 1C shows a side view of the baffle. Baffle 110 includes an elongate body 120 extending along an axis 112 from a first end 130 to a second end 134, as shown in FIG. 1B. Elongate body 120 has a depth 126 (FIG. 1A) that forms a cross-section which includes a narrow portion 140 that extends away from axis 112 along a first direction 114. The cross-section of elongate body 120 also has a wide portion 142 that includes a first projection 144 extending laterally outward from the first direction 114 and a second projection 146 that also extends laterally outward from the first direction 114. While axis 112 has a fixed position with respect to the entire baffle 110, the first direction 114 corresponds to a vector that may be positioned anywhere along the length of baffle 110. In some embodiments, such as in baffle 110, the first direction 114 may intersect axis 112.

The configuration of baffle 110, where the narrow portion 140 extends in the first direction 114 from axis 112 and the wide portion 142 has projections 144, 146 that extend laterally outward from the first direction 114 allows the baffle to present a different appearance depending on which side the baffle is viewed from. For example, as shown and described further below, a row of baffles having the same construction as baffle 110 will present a surface when viewed from one side that appears significantly more closed than when viewed from the opposite side. In particular, when a viewer looks at a row of baffles 110, the overall size of the opening between the baffles 110 is fixed. However, if the viewer observes the row of baffles from the side that is closer to the narrow portions 140, the spacing between the baffles will appear larger and have a more open visual effect. On the other hand, if the viewer observes the row of baffles from the side that is closer to the wide portion 142, the spacing between the baffles will appear smaller and have a more enclosed and private visual effect. Of course, the baffles can also be arranged at angles to one another or in opposing directions to provide other interesting visual effects.

Baffle 110 also includes a first aperture 132 extending into first end 130 of elongate body 120 along axis 112. As shown in FIG. 1C, baffle 110 also includes a second aperture 136 extending into second end 134 of elongate body 120 along axis 112. Each of the first aperture 132 and second aperture 136 is configured to receive a rod or pin for supporting baffle 110, as described in more detail below. Because the apertures 132, 136 are positioned at the opposing ends 130, 134 of the baffle 110, the baffle can be held in position without any visual structural support along the length of the elongate body 120. Accordingly, when a building surface is formed by a row of baffles having a similar configuration to baffle 110, the building surface can stretch across a desired space without any visible structural support except at the opposing ends of the baffles.

Figure 2:
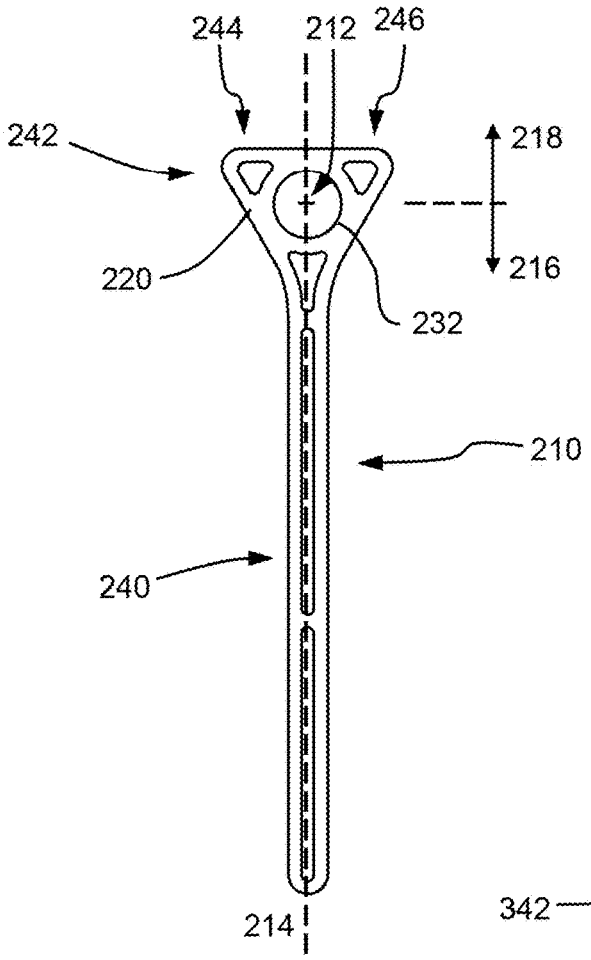
FIG. 2 is a schematic end view of a baffle according to another embodiment of the disclosure.

FIG. 2 shows another embodiment of baffle according to an embodiment of the disclosure. Baffle 210 includes an elongate body 220 extending along an axis 212. The cross-section of elongate body 220, which forms its depth and width, includes a narrow portion 240 that extends away from axis 212 along a first direction 214 and a wide portion 242. The wide portion 242 includes a first projection 244 extending laterally outward from first direction 214 and a second projection 246 that also extends laterally outward from first direction 214. Baffle 210 also includes a first aperture 232 extending into elongate body 220 along axis 212 at the first end as well as a second aperture that extends into elongate body 220 along axis 212 at the second end.

In certain embodiments of the baffle as otherwise described herein, the first and second projections extend perpendicularly to the first direction. For example, in baffle 110, first projection 144 and second projection 146 both extend laterally outward, away from narrow portion 140, in a direction that is perpendicular to the first direction 114, i.e., the direction in which narrow portion 140 extends. Similarly, the first projection 244 and second projection 246 of baffle 210 shown in FIG. 2, also extend laterally outward in a direction that is perpendicular to first direction 214. In other words, both baffle 110 and baffle 210 are configured such that, at a cross-section of the respective elongate body, the shape of the capital letter "T" can fit entirely inside the outer surface of the elongate body. More specifically, the arms of the "T" can extend outward to the distal ends of the projections and the leg of the "T" can extend to the distal end of the narrow portion with the entirety of the "T" confined within the outside surface of the cross-section.

Figure 3:
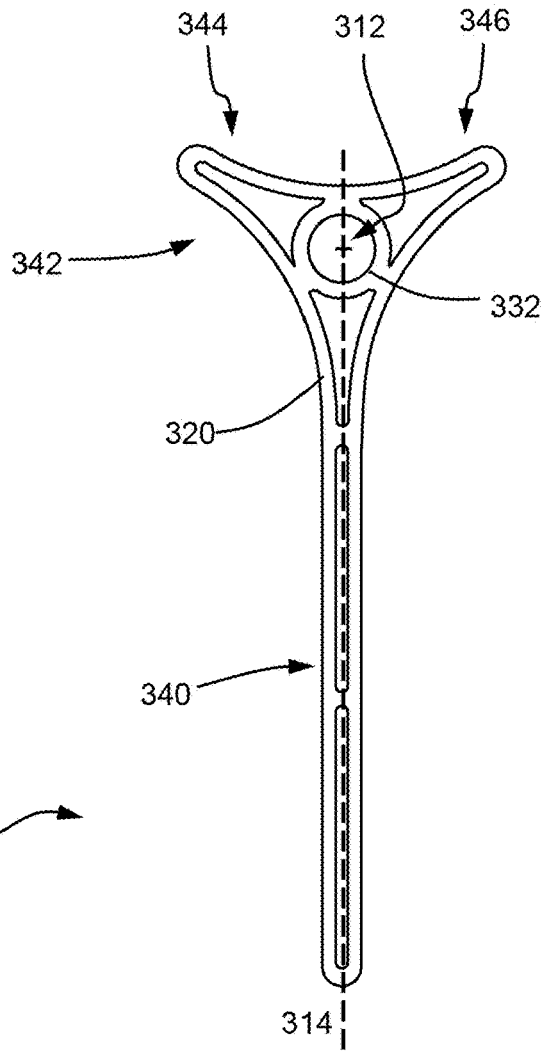
FIG. 3 is a schematic end view of a baffle according to another embodiment of the disclosure.

In other embodiments, however, the first and second projections extend at an acute or obtuse angle to the first direction. For example, in some embodiments, the cross-section of the baffle has a configuration similar to the letter "Y" while in other embodiments, the cross-section of the baffle has a configuration similar an arrow. An embodiment of such a configuration is shown in FIG. 3. Baffle 310 includes an elongate body 320 extending along an axis 312. The cross-section of elongate body 320 includes a narrow portion 340 that extends away from axis 312 along a first direction 314 and a wide portion 342. The wide portion 342 includes a first projection 344 and a second projection 346. First projection 344 and second projection 346 extend laterally outward in opposite directions from first direction 314 at an angle.

In certain embodiments of the baffle as otherwise described herein, the narrow portion of the elongate body is disposed on a first side of the axis and the wide portion is disposed on a second side of the axis that is opposite the first side. For example, as shown in FIG. 1B, narrow portion 140 of elongate body 120 is disposed on a first side 116 of axis 112, while the wide portion 142, particularly the widest section of elongate body 120, is disposed on the second side 118 of axis 112, opposite narrow portion 140. Likewise, as shown in FIG. 2, narrow portion 240 of elongate body 220 is disposed on a first side 216 of axis 212 while wide portion 242 is disposed on a second side 218 of axis 212. Alternatively, in other embodiments, the wide portion is aligned with the axis. For example, in some embodiments, each of the narrow portion, first projection and second projection extends outward from the axis. In some embodiments with such a configuration the projections extend in a direction perpendicular to the narrow portion, while in other embodiments the projections extend at an angle to the narrow portion.

In certain embodiments of the baffle as otherwise described herein, the width of the baffle tapers between the wide portion and a distal end of the narrow portion. For example, the outer surface of elongate body 120 of baffle 110 tapers along a concave curved profile from the wide portion 142 to the narrow portion 140. The tapered shape of the elongate body forms a smooth transition between the projections 144, 146 of wide portion 142 to the long extension of narrow portion 140. Similarly, the outer surface of elongate body 220 of baffle 210 also tapers between the wide portion 242 and narrow portion 240. Unlike that of baffle 110, however, the surface of baffle 210 tapers toward narrow portion 240 at a straight angle rather than a curved profile. Still, in other embodiments, the first and second projections extend sharply outward from the narrow portion with an abrupt rather than gradual change in the width of the elongate body.

In certain embodiments of the baffle as otherwise described herein, the first and second apertures are formed by a through hole that extends along the axis. For example, as shown in FIG. 1C, elongate body 120 of baffle 110 includes a through hole 138 that forms the first aperture 132 at first end 130 of elongate body 120 and the second aperture 136 at second end 134 of elongate body 120. Accordingly, the two apertures 132, 136 are connected and a rod may be inserted through the entire length of baffle 110 along through hole 138 to support baffle 110. Alternatively, in other embodiments the two apertures are not connected. For example, in some embodiments, each of the first aperture and second aperture in the respective ends of the elongate body may be blind holes. In such an embodiment, shorter individual pins may be inserted into the respective blind holes that form the apertures. Of course, it is also possible to insert such individual pins into the opposing ends of the through hole 138 of elongate body 120 of baffle 110.

In certain embodiments of the baffle as otherwise described herein, the axis is at the center of the through hole. For example, elongate body 120 of baffle 110, through hole 138 is circular, and axis 112 is at the center of through hole 138. In other embodiments, the through hole may have a different shape and the axis may be positioned at another location that is off-center with respect to the through hole or is outside the through hole entirely.

In certain embodiments of the baffle as otherwise described herein, the elongate body includes a hollow cylindrical core surrounding the axis. For example, baffle 110 has such a configuration. Specifically, elongate body 120 includes a cylindrical core 150 that forms an annular wall surrounding axis 112. The cylindrical core 150 has a similar configuration to a pipe and the open interior forms the through hole 138 and apertures 132, 136 at the respective ends 130, 134 of elongate body 120. The wall of the cylindrical core 150 forms a solid structure for supporting the baffle when a rod or pins are placed in the apertures 132, 136. Moreover, the cylindrical core can also support the outer features of baffle. For example, each of the narrow portion 140, first projection 144, and second projection 146 extends outward from cylindrical core 150 which holds and supports these extended features.

Figure 4A:
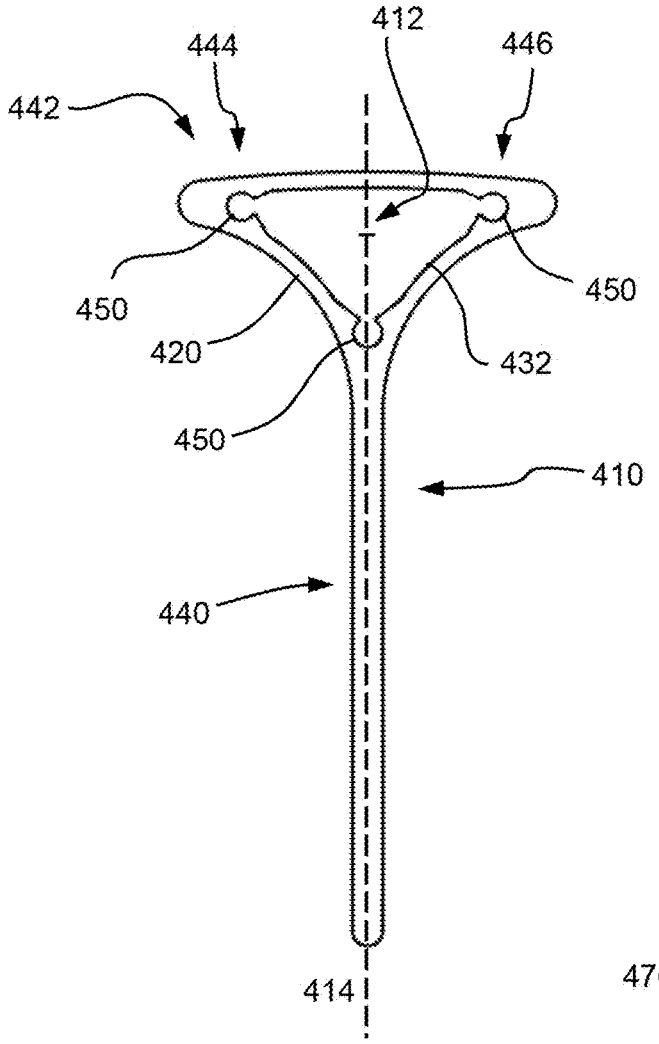
FIG. 4A is a schematic end view of a baffle according to yet another embodiment of the disclosure.

In some embodiments, each end of the elongate body includes a single location configured to receive a corresponding pin segment. For example, baffle 110 is configured to receive a pin segment at each end 130, 134 within the cylindrical core 150. In other embodiments, the baffle includes a plurality of locations configured to receive pin segments. For example, in some embodiments, the baffle includes several openings configured to receive respective pin segments in the form of mechanical fasteners, such as screws. An embodiment of such a configuration is shown in FIG. 4A. Baffle 410 includes an elongate body 420 extending along an axis 412. The cross-section of elongate body 420 includes a narrow portion 440 that extends away from axis 412 along a first direction 414 and a wide portion 442. The wide portion 442 includes a first projection 444 and a second projection 446. Baffle 410 also includes three openings 450 around first aperture 432 that are each configured to receive a respective pin segment in the form of a mechanical fastener.

Figure 4B:
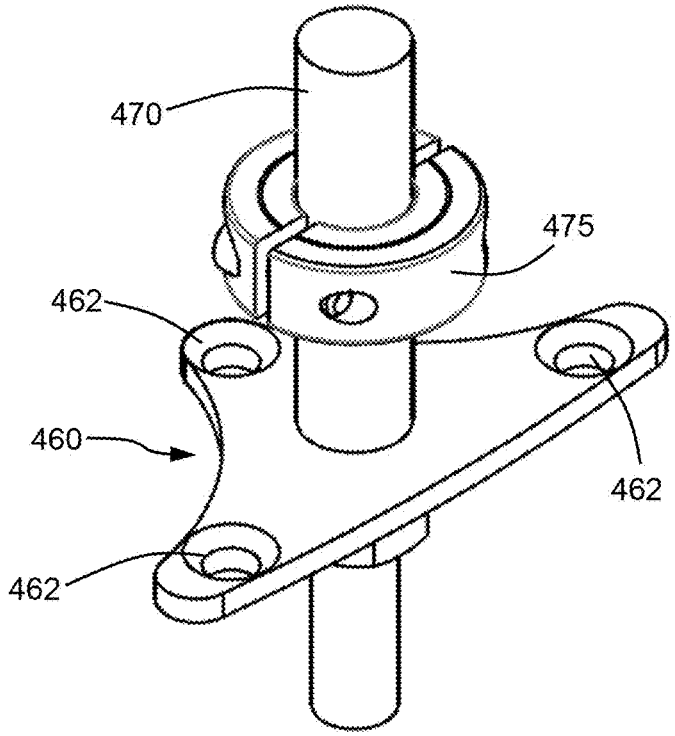
FIG. 4B is a schematic perspective view of an end cap and pin according to an embodiment of the disclosure.

In some embodiments, the body of the baffle is configured to directly engage and secure the pin segments. For example, the cylindrical core 150 of baffle 110 is configured to receive a pin segment so as to directly secure the pin segment to the elongate body 120 of the baffle. In other embodiments, the baffle may include end caps that are attached to the elongate body and secure a pin segment at the respective end of the baffle. For example, FIG. 4B shows a pin segment 470 attached to an end cap 460 that is configured to be secured at an end of the elongate body of a baffle. Specifically, end cap 460 includes three apertures 462 that are positioned to align with the openings 450 in elongate body 420. Accordingly, end cap 460 can be secured to elongate body 420 with screws that are inserted through the apertures 462 in end cap 460. As a result pin segment 470 extends into first aperture 432 but does not directly engage a surface of first aperture 432. Instead, the end cap 460 holds pin segment 470 in place at the end of elongate body 420.

The pin segment 470 may be used to secure baffle 410 in a support structure, as described in further detail below. A collar 475 is secured to pin segment 470 and may be used to secure the pin segment 470 in place in the support structure.

Figure 5:
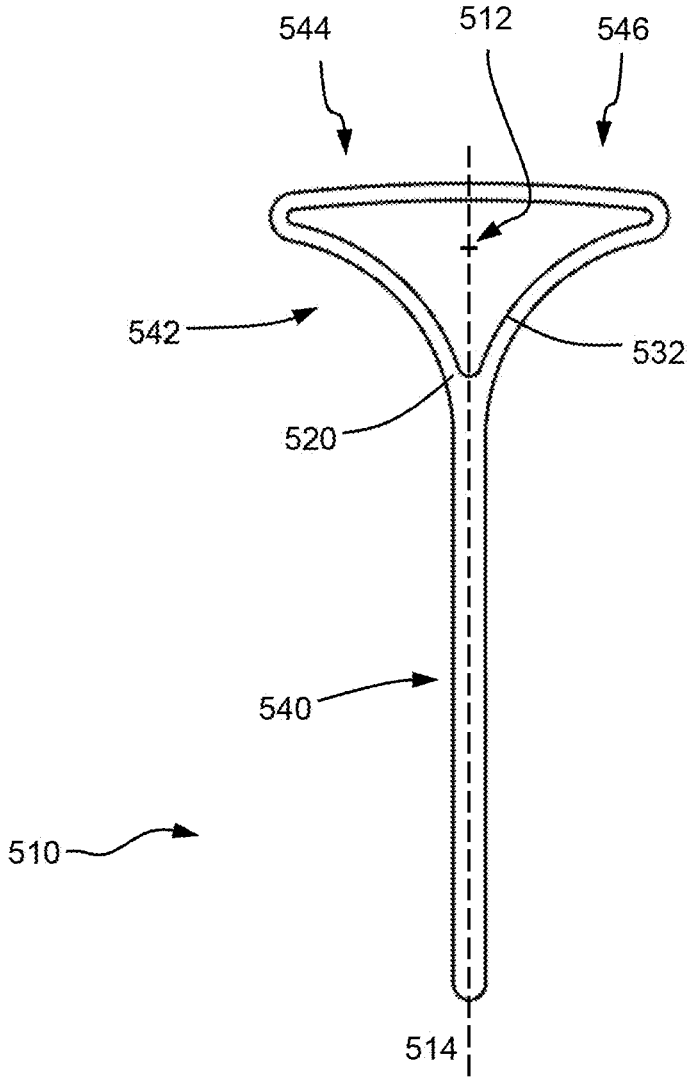
FIG. 5 is a schematic end view of a baffle according to another embodiment of the disclosure.

Further, while some embodiments include openings specifically shaped to receive a pin segment, such as the hollow core 150 of baffle 110 and the openings 450 of baffle 410, in other embodiments, the aperture does not include an opening specifically shaped to receive a pin segment. Instead, in some embodiments, the interior of the baffle includes an irregular hollow cross section, for example based on the exterior shape of the baffle or other design considerations. An embodiment of such a configuration is shown in FIG. 5. Baffle 510 includes an elongate body 520 extending along an axis 512. The cross-section of elongate body 520 includes a narrow portion 540 that extends away from axis 512 along a first direction 514 and a wide portion 542. The wide portion 542 includes a first projection 544 and a second projection 546. A first aperture 532 of baffle 510 has an irregular shape that follows the exterior surface of elongate body 520.

In certain embodiments of the baffle as otherwise described herein, the first and second projections include a hollow interior. Likewise, in certain embodiments of the baffle as otherwise described herein, the narrow portion includes a hollow interior. For example, the outside of elongate body 120 of baffle 110 is formed by an exterior wall 148 that provides the outside surface of each of the narrow portion 140 and projections 144, 146. The exterior wall 148 is coupled to the cylindrical core 150 at various locations around the perimeter of cylindrical core 150. Inside exterior wall 148, each of the narrow portion 140 and projections 144, 146 has a respective hollow interior 158, 154, 156. For example, first projection 144 has a hollow interior 154 between cylindrical core 150 and exterior wall 148 and second projection 146 also has a hollow interior 156 on the opposite side of cylindrical core 150 between cylindrical core 150 and exterior wall 148. Likewise, narrow portion 140 includes a hollow interior between opposing sides of the exterior wall 148 along the first direction 114.

In certain embodiments of the baffle as otherwise described herein, the elongate body is formed as a single integral piece. For example, in some embodiments, the elongate body is formed by a single material that extends throughout the elongate body without mechanical or adhesive connections holding separate parts together. On the other hand, in other embodiments, the elongate body is formed by two or more pieces that are attached to one another with mechanical fasteners, such as screws. Likewise, in other embodiments the elongate body is formed by two or more pieces that are bonded to one another. Further still, in some embodiments, the elongate body includes pieces that are both mechanically fastened and bonded to one another.

In certain embodiments of the baffle as otherwise described herein, the elongate body is an extruded member. For example, in some embodiments the elongate body of the baffle is formed by an extruder that extrudes the elongate body along its length. Accordingly, in some embodiments, the elongate body has a uniform cross-sectional shape along its length. For example, in some embodiments, the elongate body is an extruded metal component. In other embodiments, the elongate body is an extruded plastic component. In other embodiments, the elongate body is cast or molded. In other embodiments, the elongate body is machined or welded from several pieces. Further, in some embodiments, the elongate body is made by an additive manufacturing process, such as 3D printing.

In some embodiments, the elongate body is formed of a metal. For example, in some embodiments the elongate body is formed of aluminum, steel or another metal. Alternatively, in some embodiments the elongate body is formed of plastic. For example, in some embodiments the elongate body is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS). Further still, in some embodiments, the elongate body is formed of a fiberglass material or reinforced material. Likewise, in some embodiments, the elongate body is formed of a natural material, such as wood, bamboo or a fibrous material. In other embodiments, the elongate body is formed of some combination of metal, plastic, fiberglass, and a natural material.

Figure 6:
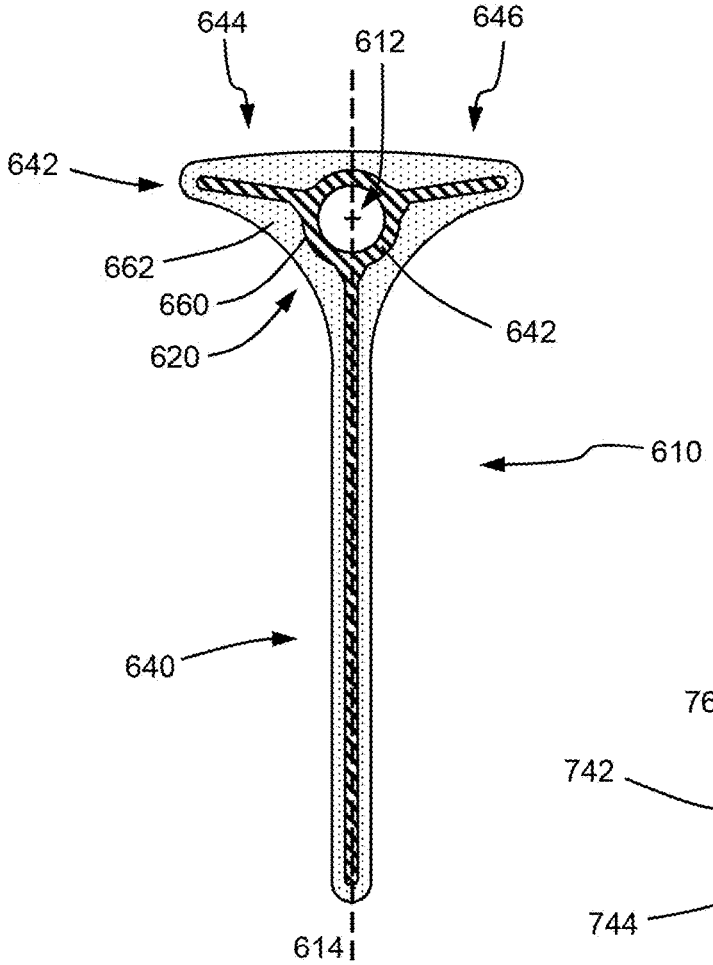
FIG. 6 is a schematic end view of a baffle according to still another embodiment of the disclosure.

In certain embodiments of the baffle as otherwise described herein, the elongate body includes an internal frame formed of a first material and a covering formed of a second material. Such an embodiment is shown in FIG. 6. Baffle 610 includes an elongate body 620 extending along an axis 612. The cross-section of elongate body 620 includes a narrow portion 640 that extends away from axis 612 along a first direction 614 and a wide portion 642 that includes a first projection 644 and a second projection 646. Elongate body 620 is formed by an internal frame 660 that is formed of a first material and a covering 662 that surrounds the internal frame 660. Internal frame 660 includes a cylindrical core 650 similar to those of the embodiments described above as well as frame projections that correspond to the narrow portion 640 and projections 644, 646.

In some embodiments, the covering fully surrounds the internal frame such that the internal frame is not visible. For example, covering 662 of elongate body 620 fully surrounds internal frame 660 along the length of baffle 610. In other embodiments, portions of the internal frame are concealed by the covering while other portions are left exposed. In some embodiments, the exposed and concealed areas of the internal frame vary around the perimeter of the elongate body. In other embodiments, the exposed and concealed areas vary along the length of the elongate body.

In certain embodiments of the baffle as otherwise described herein, the second material comprises felt. For example, in some embodiments, the elongate body includes a felt covering over a metal internal frame. The use of felt can help provide acoustic characteristics to the baffles to help attenuate sounds. In other embodiments, the elongate body includes a felt covering over a plastic internal frame. Still, in other the elongate body includes a plastic covering over a metal internal frame.

In certain embodiments of the baffle as otherwise described herein, the elongate body is covered with a coating. In some embodiments, the coating is decorative and imparts a particular visual aspect to the baffle. For example, in some embodiments the coating is opaque and has a particular color. In other embodiments, the coating is transparent. In some embodiments, the coating is variegated, such that different portions of the elongate body have different colors. For example, in some embodiments, the coating is partially transparent such that sections of the underlying material of the elongate body show through the coating while other sections are overlaid with an opaque covering. In some embodiments the coating includes an image of a natural product, such as wood.

In some embodiments, the coating is provided as a liquid that is sprayed or otherwise applied onto the elongate body. In other embodiments the coating is a film or laminate that is stretched over or otherwise applied to the elongate body. Still, in other embodiments the coating is a coextruded layer formed with the elongate body during an extrusion or molding process.

Figure 7:
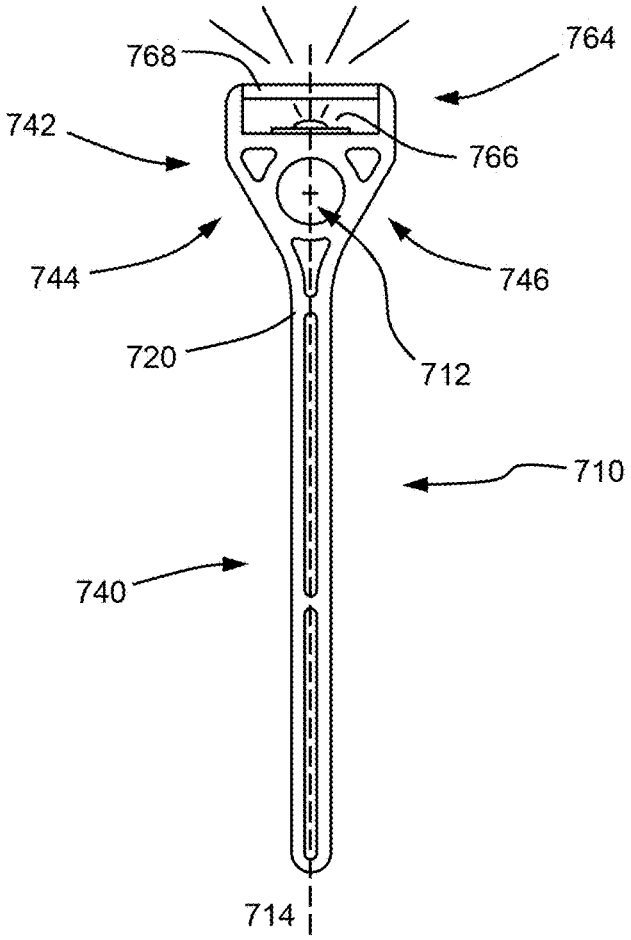
FIG. 7 is a schematic end view of a baffle according to another embodiment of the disclosure.

In certain embodiments of the baffle as otherwise described herein, the elongate body includes a light source. Such an embodiment is shown in FIG. 7. Baffle 710 includes an elongate body 720 extending along an axis 712. The cross-section of elongate body 720 includes a narrow portion 740 that extends away from axis 712 along a first direction 714 and a wide portion 742 that includes a first projection 744 and a second projection 746 that extend laterally outward from the first direction 714. The wide portion 742 also includes a light source 764 configured to emit light from baffle 710, so that baffle 710 also forms a lighting element. While the light source in baffle 710 is positioned on wide portion 742, in other embodiments, the light source is positioned in another area. For example, in some embodiments, the light source is positioned on the narrow portion, either along the first direction, at the distal end of the narrow portion, or in both locations. Further, in some embodiments, the light source is positioned at the outer ends of one or both of the first projection or second projection of the wide portion. Further, these lighting positions could be singular or multiple, and could extend continuously or discretely along any chosen axis or direction.

In some embodiments the light source includes a plurality of LEDs. For example, light source 764 in elongate body 720 of baffle 710 includes a plurality of LEDs 766 arranged in a line along the length of elongate body 720. The term LED as used herein includes conventional LEDs, organic light emitting diodes (OLEDs) and quantum dot LEDs. In other embodiments, the light source may be in the form of a lamp, such as an incandescent, fluorescent, or halogen bulb. Still, in other embodiments, the light source may be in the form of another lighting element, such as a laser or an optical fiber.

In some embodiments, the light source includes a lens. For example, light source 764 of baffle 710 includes a lens 768 disposed over LEDs 766. Lens 768 forms a portion of the outer surface of elongate body 720, thereby providing a cohesive appearance.

In certain embodiments of the baffle as otherwise described herein, a length of the baffle from the first end to the second end is at least 3 feet in length, e.g., at least 4 feet, e.g., at least 6 feet, e.g., at least 8 feet. Further, in certain embodiments of the baffle as otherwise described herein, a length of the baffle from the first end to the second end is no more than 40 feet in length, e.g., no more than 30 feet, e.g., no more than 25 feet, e.g., no more than 20 feet. For example, in some embodiments, the baffle has a length in a range from 3 feet to 40 feet, e.g., 4 feet to 30 feet, e.g., from 6 feet to 25 feet, e.g., from 8 feet to 20 feet.

In certain embodiments of the baffle as otherwise described herein the depth of the baffle is at least 3 inches, e.g., at least 4 inches, e.g., at least 6 inches. Further, in certain embodiments of the baffle as otherwise described herein, the depth of the baffle is no more than 4 feet, e.g., no more than 3 feet, e.g., no more than 2 feet. For example, in some embodiments, the baffle has a depth in a range from 3 inches to 4 feet, e.g., from 4 inches to 3 feet, e.g., from 6 inches to 2 feet.

In certain embodiments of the baffle as otherwise described herein, a width of the baffle from a distal end of the first projection to a distal end of the second projection is at least 1 inch, e.g., at least 2 inches. Further, in certain embodiments of the baffle as otherwise described herein, a width of the baffle from a distal end of the first projection to a distal end of the second projection is no more than 12 inches, e.g., no more than 9 inches, e.g., no more than 8 inches, e.g., no more than 6 inches. For example, in some embodiments, the baffle has a width in a range from 1 inch to 12 inches, e.g., from 2 inch to 8 inches, e.g. from 2 inches to 6 inches.

In another aspect, the disclosure provides a building surface system that includes a first support structure, a second support structure, and a plurality of baffles according to the disclosure extending from the first support structure to the second support structure. Each baffle of the system is supported at its first end by a respective first pin segment that is inserted into the first aperture and is supported at its second end by a respective second pin segment that is inserted into the second aperture.

Figure 8:
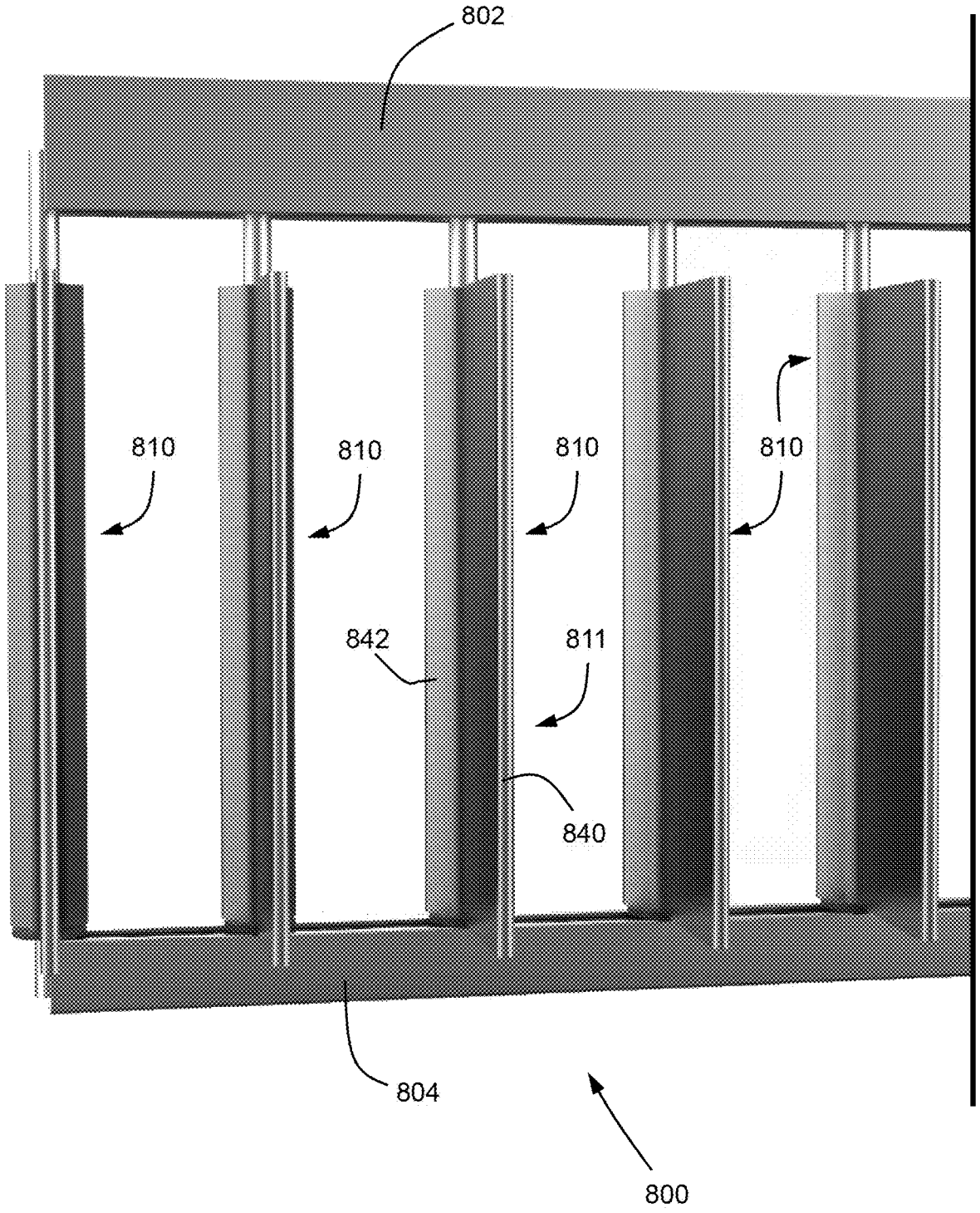
FIG. 8 is a schematic perspective view of a building surface system according to an embodiment of the disclosure.
Figure 9:
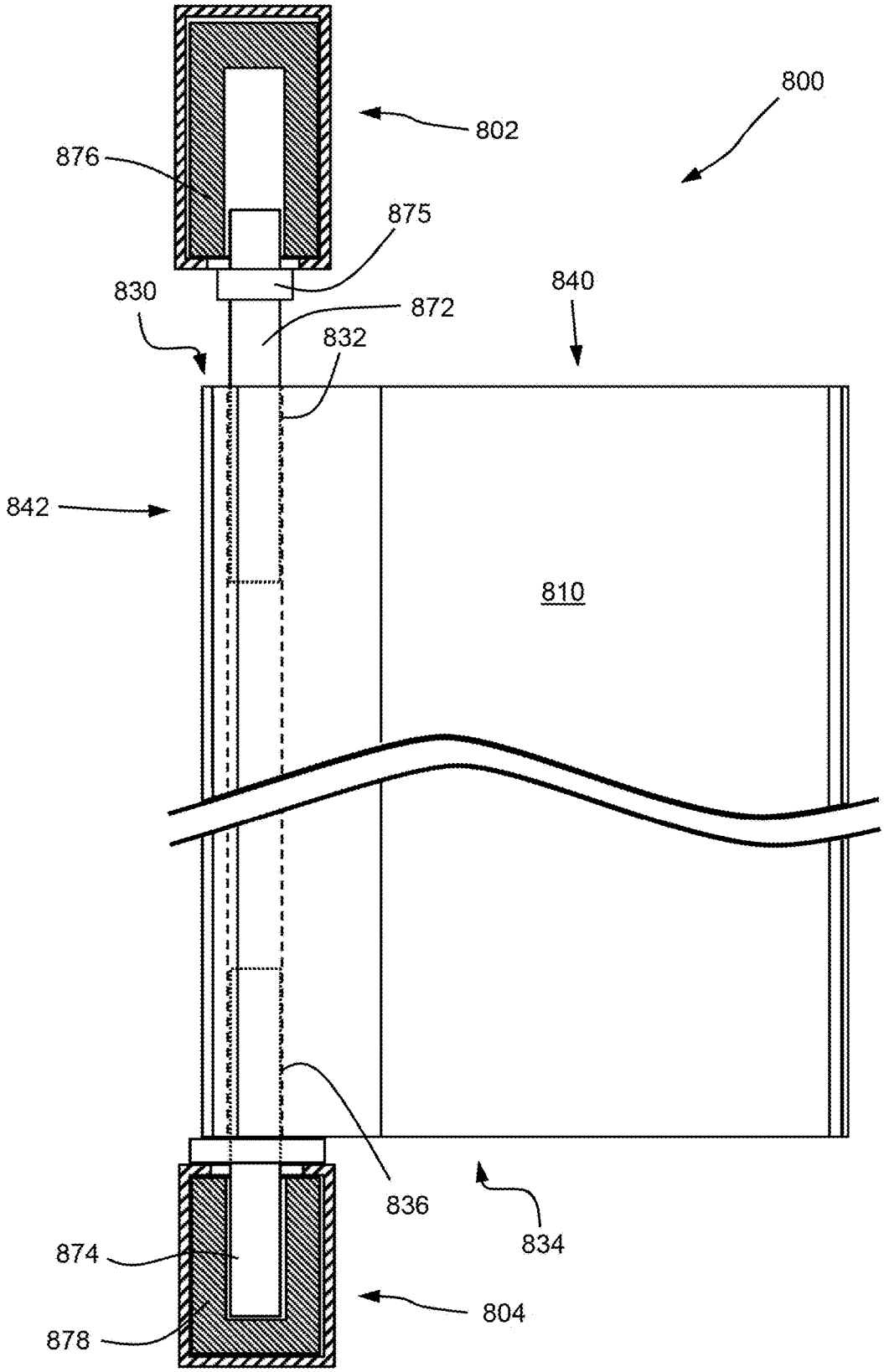
FIG. 9 is a schematic end view of the building surface system of FIG. 8.

Such a building surface system is shown in FIGS. 8 and 9. Building surface system 800 includes a plurality of baffles 810 that each include a narrow portion 840 and a wide portion 842 as shown with respect to first baffle 811 identified in FIG. 8 and shown in a side view in FIG. 9. Each of the baffles 810 extends from a first support structure 802 to a second support structure 804. Baffles 810 are supported at their respective first ends 830 by a first pin segment 872 that is inserted into the first aperture 832 of the respective baffle 810, as shown in FIG. 9. Likewise, baffles 810 are supported at their respective second ends 834 by a second pin segment 874 that is inserted into the second aperture 836 of the respective baffle 810, as also shown in FIG. 9.

The baffles 810 may be coupled to the respective support structures 802, 804 by inserting the ends of the pin segments 872, 874 into openings in the respective support structures 802, 804 and then securing the pin segments 872, 874 in place. For example, first pin segment 872 may initially be inserted into the opening in first support structure 802 so that first pin segment 872 reaches the upper end of first support structure 802. Second pin segment 874 may then be aligned with the opening in second support structure 804. The baffle 810 may then be lowered so that second pin segment 874 is inserted into second support structure 804. The baffle 810 and pin segments 872, 874 can then be secured in place using a collar 875 that surrounds first pin segment 872 and hinders upward movement of the baffle 810.

In certain embodiments of the building surface system as otherwise described herein, each pair of first and second pin segments is formed by a rod that extends through the entire elongate body. For example, in some embodiments a rod is coupled to each baffle and extends through the baffle from the first aperture at the first end to the second aperture at the second end. Moreover, the rod extends beyond the two ends of the baffle to be secured within the first and second support structures. Accordingly, the rod that corresponds to each baffle forms both the first pin segment and the second pin segment associated with that baffle. In other embodiments, the first and second pin segments are discrete components. For example, in building surface system 800, the first pin segment 872 and second pin segment 874 are separate and respectively positioned at opposing ends of the baffle 810.

Figure 10:
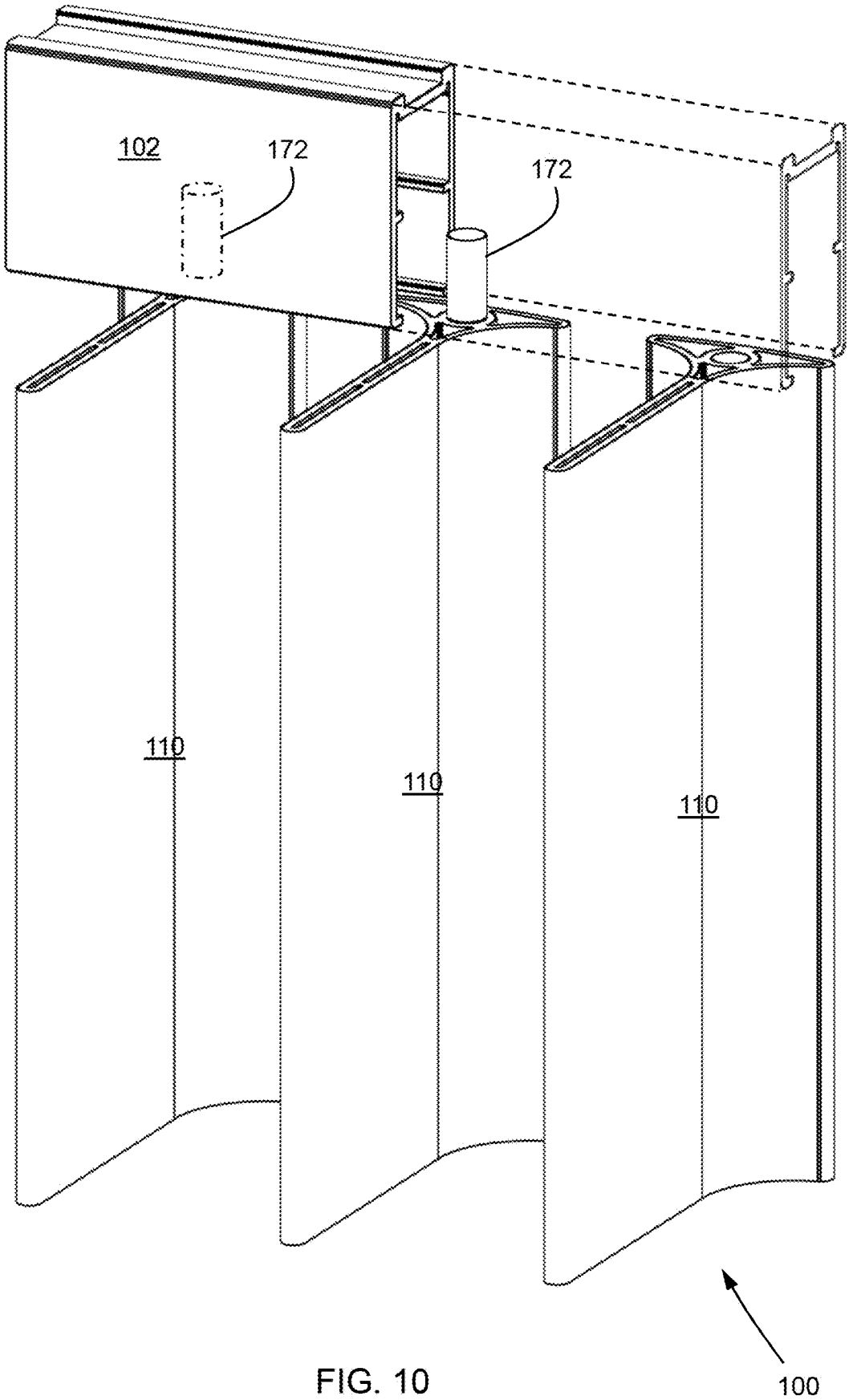
FIG. 10 is a schematic perspective view of a portion of a building surface system according to an embodiment of the disclosure with baffles in a first position.
Figure 11:
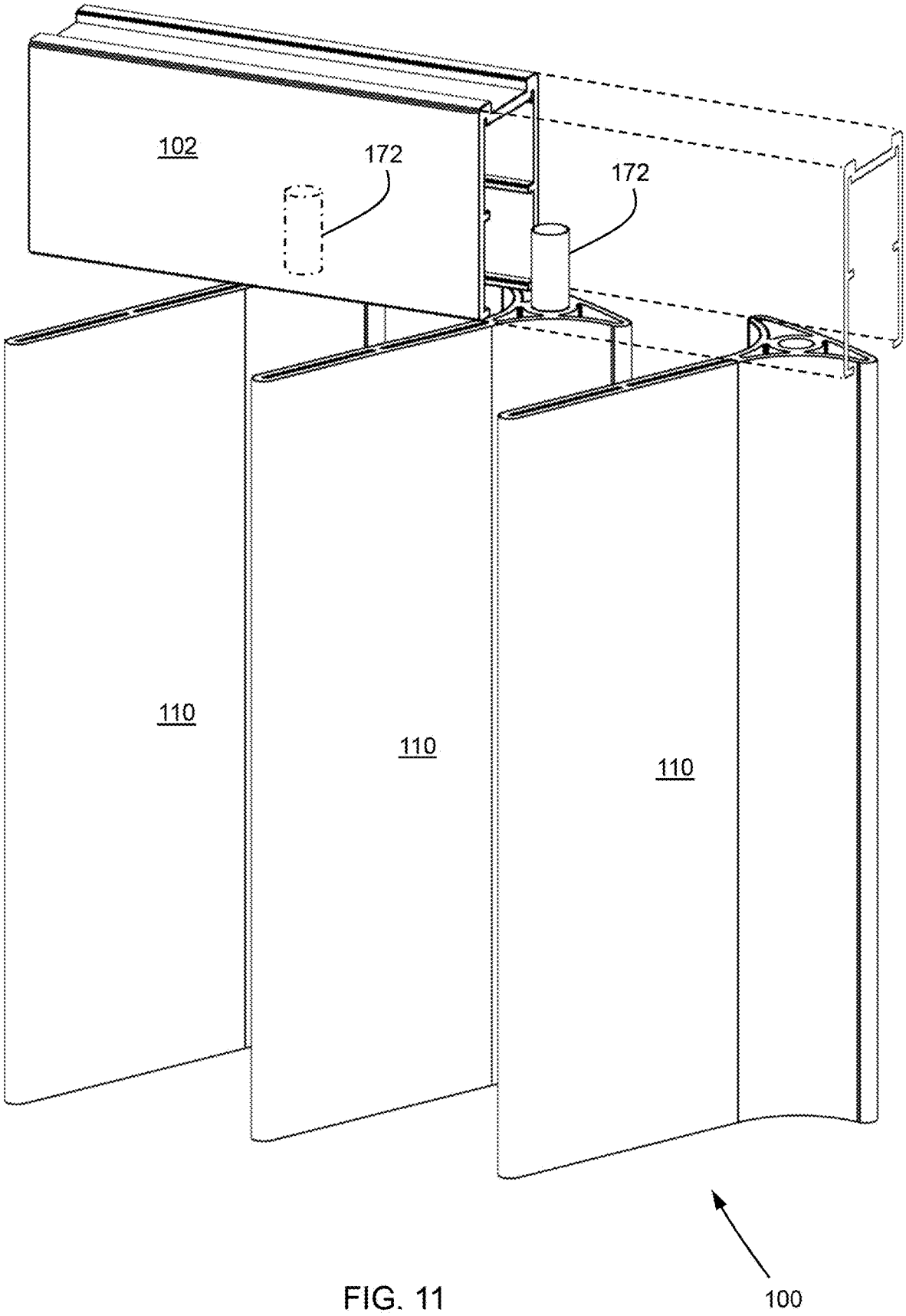
FIG. 11 is a schematic perspective view of the building surface system of FIG. 10 with the baffles in a second position.

In certain embodiments of the building surface system as otherwise described herein, each of the baffles is rotatable about a respective axis. For example, FIGS. 10 and 11 illustrate an embodiment of a building surface system according to the disclosure with the baffles rotated to two different positions. Building surface system 100, partially shown in FIGS. 10 and 11 includes baffles 110 that have the same configuration as those shown in FIGS. 1-3. The elongate body 120 of each baffle 110 is secured to a first support structure 102 using a first pin segment 172, as shown with respect to the middle baffle. In FIG. 10, the baffles 110 are oriented so that the direction of extension of the narrow portion 140 of each baffle 110 is perpendicular to the direction of the first support structure 102. In contrast, in FIG. 11, the baffles have been rotated about their respective axes (see FIGS. 1 and 2) so that the direction of extension of the narrow portion 140 of each baffle is at an angle to the direction of the first support structure 102. In other embodiments, the baffles have a fixed orientation. It will be appreciated that the baffles could be rotated to all be at the same respective angle to each other (as shown in FIG. 10 and FIG. 11) or that each baffle could be rotated independently to different angles with respect to each other. Such flexibility of the rotation angle allows for a variety of aesthetic effects, or change of visible sight lines through the building surface system for privacy or illumination purposes.

In certain embodiments of the building surface system as otherwise described herein, the first support structure is a first rail that holds the respective first ends of the baffles at respective positions spaced along the length of the first rail. For example, the first support structure of building surface system 800 is configured as a first rail 802 that supports the respective first pin segments 870 at regular intervals along the length of the first rail 802. Accordingly, the baffles 810 are similarly held at regular intervals based on the spacing of the first pin segments 872 along the first rail 802. Similarly, the second support structure of building surface system 800 is also configured as a second rail 804 that supports the respective second pin segments 874 along regular intervals. Similarly, the first support structure of building surface system 100, as shown in FIGS. 10 and 11, is also configured as a first rail 102 that holds the respective first pin segments 172 along the length of the rail.

In some embodiments, the rails are secured over the surface of a building structure, such as a floor, enclosed ceiling, or a wall. In other embodiments, the rails are embedded in such a building structure. Still, in other embodiments the rails are suspended from a building structure and not immediately adjacent to any other structures.

In some embodiments, either or both of the support structures are not rails and have another configuration. For example, in some embodiments, the first support structure is formed by a ceiling, a floor, or a wall that includes receptacles for the pin segments.

In some embodiments, the rails that support the baffles are linear. For example, the first rail 802 and the second rail 804 in building surface system 800, as shown in FIG. 8, are straight rails. Likewise, first rail 102 of building surface system 100, as shown in FIGS. 10 and 11, are also straight rails. In other embodiments the rails are curved. For example, in some embodiments, the rails curve so as to position the baffles along a curving profile.

In some embodiments, the length of the first rail is at least 3 feet, e.g., at least 6 feet, e.g., at least 8 feet. The length of the first rail can vary depending the size of the building surface that is being installed and the number of baffles that are being used. In some embodiments, the length of the first rail is limited by manufacturing and transportation limitations. For example, in some embodiments, the first rail is no more than 50 feet, e.g., no more than 25 feet. In other embodiments, the first rail is longer.

In certain embodiments of the building surface system as otherwise described herein, the first pin segments are held in the first rail. For example, as shown in the cross-sectional view of FIG. 9, the first rail 802 is formed as an open rail and the first pin segment 872, which is held at the first end of baffle 810, is inserted into the first rail 802. Accordingly, the first rail 802 holds the first pin segment 872 and the first end of baffle 810 in place. Likewise, the second pin segment 874 is similarly held within the second rail 804 at the second end of baffle 810.

Figure 12:
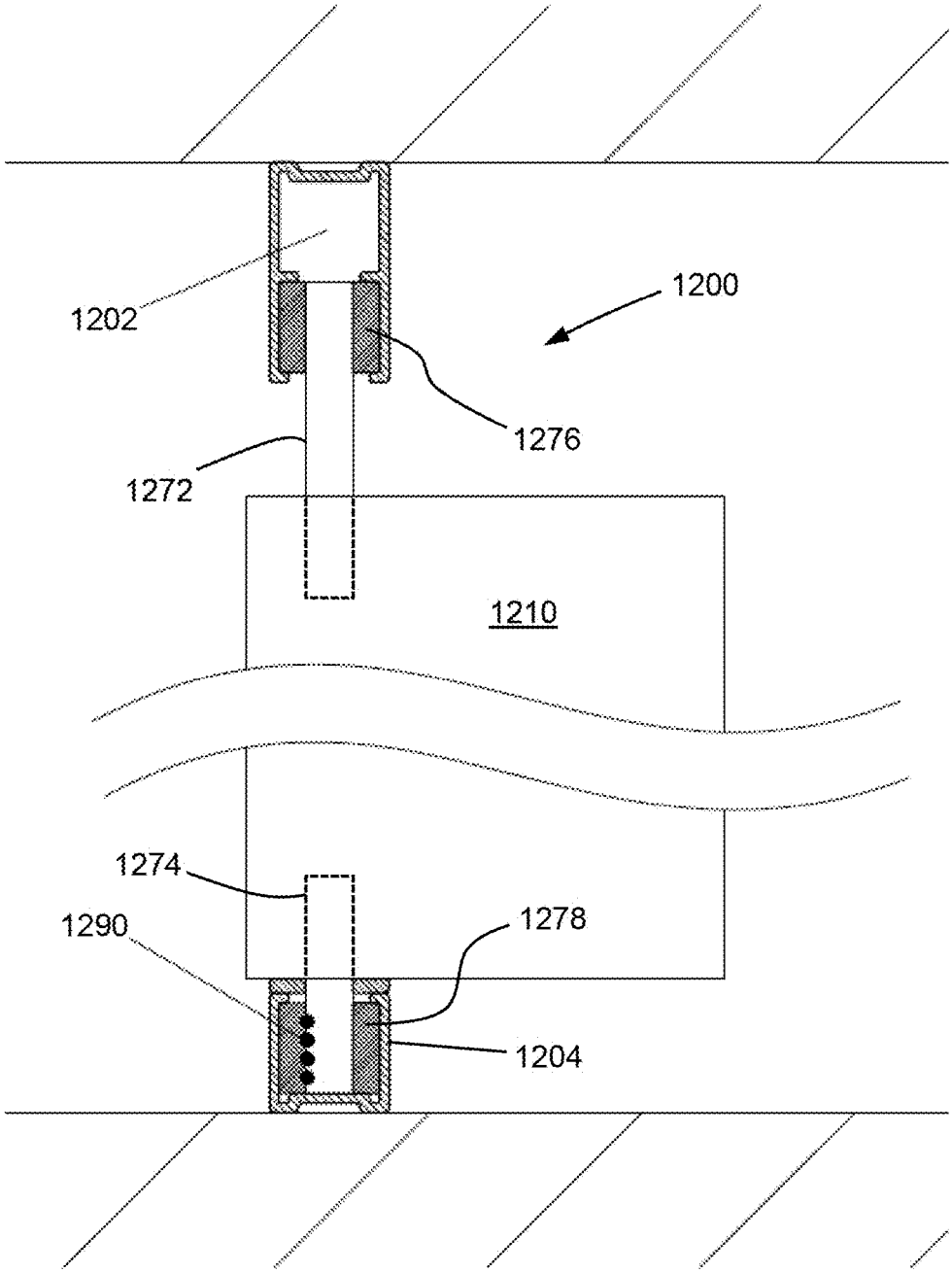
FIG. 12 is a schematic end view of a building surface system according to another embodiment of the disclosure.

In certain embodiments of the building surface system as otherwise described herein, the first rail includes an insert that has a plurality of sockets configured to receive the first pin segments. For example, as shown in FIG. 9, the first pin segment 872 is retained by a first insert 876 that is disposed within first rail 802. Likewise, second pin segment 874 is retained by a second insert 878 that is disposed within the second rail 804. FIG. 12 illustrates a cross-sectional side view of another embodiment of a building surface system according to the disclosure that includes such a configuration. Building surface system 1200 includes a plurality of baffles 1210 that extend from a first support structure in the form of a first rail 1202 to a second support structure in the form of a second rail 1204. The first pin segment 1272 extending from the first end of baffle 1210 is held by a first insert 1276 that is secured in first rail 1202. Likewise, the second pin segment 1274 is held by a second insert 1278 that is secured in the second rail 1204. In some embodiments, the inserts run along the length of the respective rails and include a plurality of positions to hold pin segments. In other embodiments, each of the pin segments is associated with an individual insert that is positioned in the rail and retains the respective pin segment in the rail.

Figure 13:
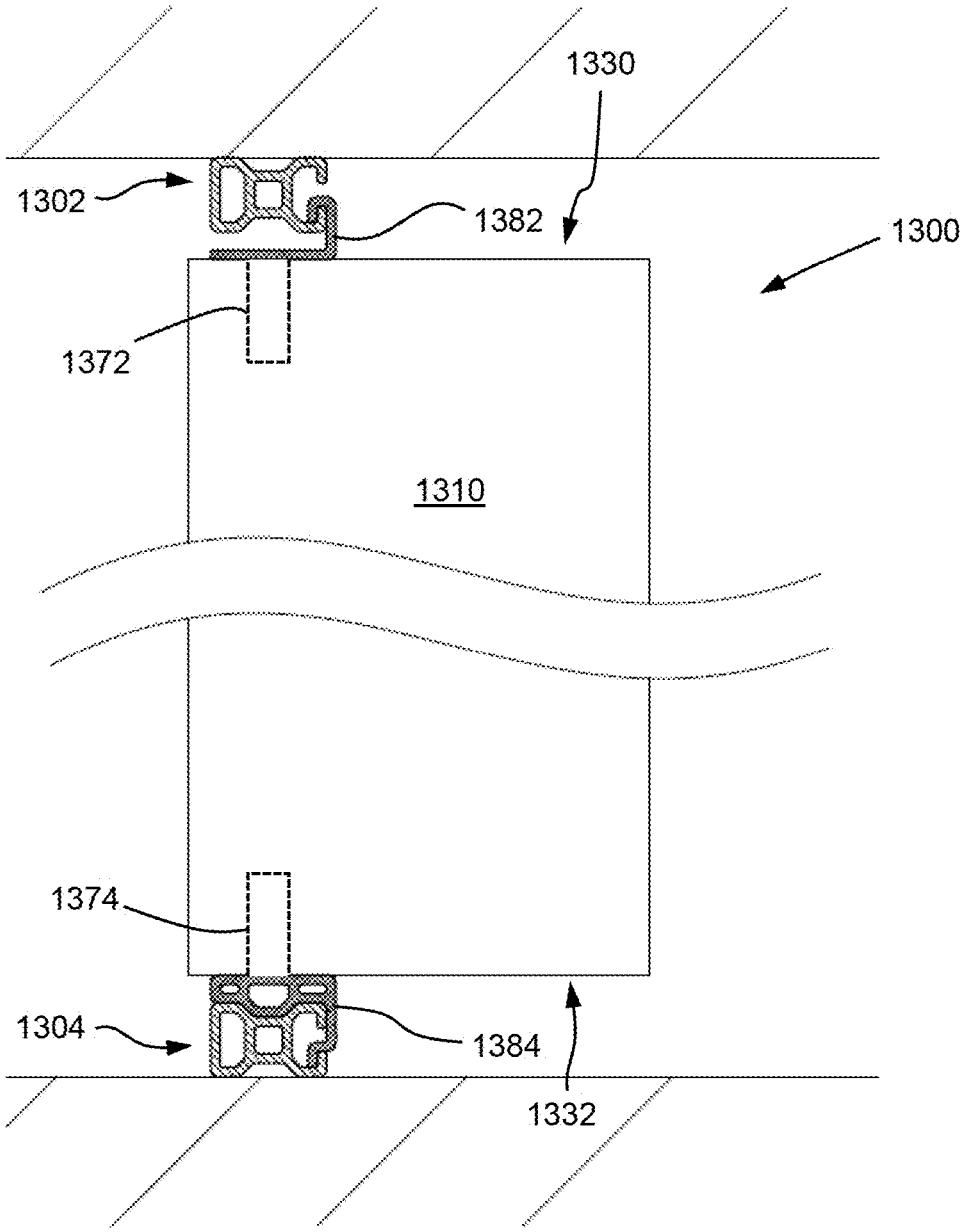
FIG. 13 is a schematic end view of a building surface system according to another embodiment of the disclosure.

In certain embodiments of the building surface system as otherwise described herein, each of the first pin segments is attached to a respective fastener that is secured to the first rail. Such an embodiment is shown in FIG. 13. Building surface system 1300 includes a plurality of baffles 1310 that extend from a first support structure in the form a first rail 1302 to a second support structure in the form of a second rail 1304. Each of the first rail 1302 and second rail 1304 is configured as a closed rail. To secure the first pin segment 1372 at the first end 1330 of baffle 1310 to first rail 1302, the first pin segment 1372 is attached to a first fastener 1382. The first fastener 1382 is configured as a hook that engages a corresponding flange 1386 on the first rail 1302. Likewise, the second pin segment 1374 at the second end 1332 of baffle 1310 is attached to a second fastener 1384 that engages the second rail 1304.

In certain embodiments of the building surface system as otherwise described herein, at least one of the first rail and second rail includes a conductor for providing power to the baffles. For example, second rail 1204 of building surface system 1200 includes a series of electrical conductors 1290 configured to provide power to baffle 1210. For example, as explained above, in some embodiments the baffle includes a light source, and the electrical conductor may provide electrical power for illuminating the light source. In other embodiments, the rail includes conductors for providing power to other components. For example, in some embodiments, the conductor provides power to actuators configured to rotate the baffles, as described above. The rail may also include conductors for carrying signals to operate components, such as the light source or an actuator.

In certain embodiments of the building surface system as otherwise described herein, the axes associated with each of the plurality of baffles lie in a common plane. For example, the axes of baffles 810 of building surface system 800 are disposed in a common plane, as shown in FIG. 8. Likewise, the axes of baffles 110 of building surface system 100, shown in FIGS. 10 and 11 are also disposed in a common plane. As a result, the baffles form a generally planar building surface. In other embodiments, the baffles may be oriented in other configurations. For example, in some embodiments, the axes of the baffles may be parallel but positioned along a curve to form a curved building surface. In some other embodiments, the axes of the baffles may be offset from each other in a non-planar way, such as a step function or a sinusoidal wave. Still in other embodiments the axes of the baffles may be angled with respect to one another.

In certain embodiments of the building surface system as otherwise described herein, the baffles extend vertically forming a room divider. For example, building surface system 800, shown in FIG. 8, is formed as a room divider, where the baffles 810 extend vertically to provide defined spaces on either side of the building surface system. In some embodiments, the first rail supports the weight of the baffles. For example, in building surface system 1200, shown in FIG. 12, and building surface system 1300, shown in FIG. 13, the respective first rail 1202 and 1302 at the upper end of the baffles supports the weight of the baffles, such that the baffles primarily hang from the respective upper rail. In such embodiments, the rail at the lower end of the baffles may hold the baffles in place and support only a fraction or none of weight of the baffles.

In other embodiments, the building surface system connects directly to a wall or ceiling surface, or is attached in a manner to be offset from such surfaces by a minimum distance to allow for rotation of the baffles along their axes. In such cases, the baffles and building surface system may be providing an illumination source, a shading function, or acoustical control or acoustical dampening to the building space.

In other embodiments, the baffles extend horizontally forming a ceiling surface. For example, in some embodiments, the baffles of the building surface system are ceiling baffles and define a ceiling surface that separates a lower occupied space from a plenum above the ceiling surface.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

Embodiments

Embodiment 1. A baffle for a building surface, the baffle comprising:

an elongate body extending along an axis from a first end to a second end, the elongate body having a depth including a narrow portion that extends away from the axis along a first direction and a wide portion, the wide portion including first and second projections that extend laterally outward from the first direction;

a first aperture extending into the first end of the elongate body along the axis; and a second aperture extending into the second end of the elongate body along the axis.

Embodiment 2. The baffle according to embodiment 1, wherein the first and second projections extend perpendicularly to the first direction.

Embodiment 3. The baffle according to embodiment 1 or embodiment 2, wherein the narrow portion of the elongate body is disposed on a first side of the axis and the wide portion is disposed on a second side of the axis that is opposite the first side.

Embodiment 4. The baffle according to any of embodiments 1 to 3, wherein the width of the baffle tapers between the wide portion and a distal end of the narrow portion.

Embodiment 5. The baffle according to any of embodiments 1 to 4, wherein first and second apertures are formed by a through hole that extends along the axis.

Embodiment 6. The baffle according to embodiment 5, wherein the axis is at the center of the through hole.

Embodiment 7. The baffle according to any of embodiments 1 to 6, wherein the elongate body includes a hollow cylindrical core surrounding the axis.

Embodiment 8. The baffle according to any of embodiments 1 to 7, wherein the first and second projections include a hollow interior.

Embodiment 9. The baffle according to any of embodiments 1 to 8, wherein the narrow portion includes a hollow interior.

Embodiment 10. The baffle according to any of embodiments 1 to 9, wherein the elongate body is formed as a single integral piece.

Embodiment 11. The baffle according to embodiment 10, wherein the elongate body is an extruded member.

Embodiment 12. The baffle according to any of embodiments 1 to 9, wherein the elongate body includes an internal frame formed of a first material and a covering formed of a second material.

Embodiment 13. The baffle according to any of embodiments 1 to 12, wherein the elongate body comprises aluminum.

Embodiment 14. The baffle according to embodiment 12 or embodiment 13, wherein the second material comprises felt.

Embodiment 15. The baffle according to any of embodiments 1 to 14, wherein the elongate body is covered with a coating.

Embodiment 16. The baffle according to any of embodiments 1 to 15, wherein baffle includes a light source.

Embodiment 17. The baffle according to any of embodiments 1 to 16, wherein a length of the baffle from the first end to the second end is at least 3 feet in length, e.g., at least 4 feet, e.g., at least 6 feet, e.g., at least 8 feet.

Embodiment 18. The baffle according to any of embodiments 1 to 17, wherein a length of the baffle from the first end to the second end is no more than 40 feet, e.g. no more than 30 feet, e.g., no more than 25 feet, e.g., no more than 20 feet.

Embodiment 19. The baffle according to any of embodiments 1 to 18, wherein the depth of the baffle is at least 3 inches, e.g., at least 4 inches, e.g., at least 6 inches.

Embodiment 20. The baffle according to any of embodiments 1 to 19, wherein the depth of the baffle is no more than 4 feet, e.g., no more than 3 feet, e.g., no more than 2 feet.

Embodiment 21. The baffle according to any of embodiments 1 to 20, wherein a width of the baffle from a distal end of the first projection to a distal end of the second projection is at least 1 inch, e.g., at least 2 inches.

Embodiment 22. The baffle according to any of embodiments 1 to 21, wherein a width of the baffle from a distal end of the first projection to a distal end of the second projection is no more than 12 inches, e.g., no more than 9 inches, e.g., no more than 8 inches, e.g., no more than 6 inches.

Embodiment 23. A building surface system comprising:

a first support structure;

a second support structure; and a plurality of baffles according to any of embodiments 1 to 22 extending from the first support structure to the second support structure, wherein each baffle is supported at the first end by a respective first pin segment that is inserted into the first aperture and is supported at the second end by respective second pin segment that is inserted into the second aperture.

Embodiment 24. The building surface system according to embodiment 23, wherein each pair of first and second pin segments is formed by a rod that extends through the entire elongate body.

Embodiment 25. The building surface system according to embodiment 23 or embodiment 24, wherein each of the baffles is rotatable about a respective axis.

Embodiment 26. The building surface system according to any of embodiments 23 to 25, wherein the first support structure is a first rail that holds the respective first ends of the baffles at respective positions spaced along the length of the first rail.

Embodiment 27. The building surface system according to embodiment 26, wherein the first pin segments are held in the first rail.

Embodiment 28. The building surface system according to embodiment 27, wherein the first rail includes an insert that has a plurality of sockets configured to receive the first pin segments.

Embodiment 29. The building surface system according to embodiment 26, wherein each of the first pin segments is attached to a respective fastener that is secured to the first rail.

Embodiment 30. The building surface system according to any of embodiments 26 to 29, wherein the second support structure is a second rail that holds the respective second ends of the baffles at respective positions spaced along the length of the second rail.

Embodiment 31. The building surface system according to any of embodiments 26 to 30, at least one of the first rail and second rail includes a conductor for providing power to the baffles Embodiment 32. The building surface system according to any of embodiments 26 to 31, wherein the axes associated with each of the plurality of baffles lie in a common plane.

Embodiment 33. The building surface system according to any of embodiments 23 to 32, wherein the baffles extend vertically forming a room divider.

Embodiment 34. The building surface system according to embodiment 33, wherein the second rail supports the weight of the baffles.

Embodiment 35. The building surface system according to any of embodiments 23 to 32, wherein the baffles extend horizontally forming a ceiling surface.

What is claimed is:

1. A building surface system comprising:

a first support structure;

a second support structure; and a plurality of baffles extending from the first support structure to the second support structure, wherein each baffle comprises:

an elongate body extending along an axis from a first end to a second end, the elongate body having a depth including a narrow portion that extends away from the axis along a first direction and a wide portion, the wide portion including first and second projections that extend laterally outward from the first direction;

a first aperture extending into the first end of the elongate body along the axis; and a second aperture extending into the second end of the elongate body along the axis, wherein each baffle is supported at the first end by a respective first pin segment that is inserted into the first aperture and is supported at the second end by respective second pin segment that is inserted into the second aperture.

2. The building surface system according to claim 1, wherein in each of the plurality of baffles the first and second projections extend perpendicularly to the first direction.

3. The building surface system according to claim 1, wherein in each of the plurality of baffles the narrow portion of the elongate body is disposed on a first side of the axis and the wide portion is disposed on a second side of the axis that is opposite the first side.

4. The building surface system according to claim 1, wherein in each of the plurality of baffles the width of the baffle tapers between the wide portion and a distal end of the narrow portion.

5. The building surface system according to claim 1, wherein in each of the plurality of baffles according to claim 1, wherein the first and second apertures are connected by a through hole that extends along the axis.

6. The building surface system according to claim 5, wherein in each of the plurality of baffles the axis is at the center of the through hole.

7. The building surface system according to claim 1, wherein in each of the plurality of baffles the first and second projections include a hollow interior.

8. The building surface system according to claim 1, wherein in each of the plurality of baffles the elongate body is formed as a single integral piece.

9. The building surface system according to claim 8, wherein in each of the plurality of baffles the elongate body is an extruded member.

10. The building surface system according to claim 1, wherein in each of the plurality of baffles the elongate body comprises aluminum.

11. The building surface system according to claim 1, wherein in each of the plurality of baffles a width of the baffle from a distal end of the first projection to a distal end of the second projection is at least 2 inches.

12. The building surface system according to claim 1, wherein in each of the plurality of baffles a width of the baffle from a distal end of the first projection to a distal end of the second projection is no more than 12 inches.

13. The building surface system according to claim 1, wherein each of the baffles is rotatable about a respective axis.

14. The building surface system according to claim 1, wherein the first support structure is a first rail that holds the respective first ends of the baffles at respective positions spaced along the length of the first rail.

15. The building surface system according to claim 14, wherein the first pin segments are held in the first rail.

16. The building surface system according to claim 14, wherein the first rail includes an insert that has a plurality of sockets configured to receive the first pin segments.

17. The building surface system according to claim 14, wherein the second support structure is a second rail that holds the respective second ends of the baffles at respective positions spaced along the length of the second rail.

18. The building surface system according to claim 1, wherein the axes associated with each of the plurality of baffles lie in a common plane.

19. The building surface system according to claim 18, wherein the baffles extend vertically forming a room divider.

* * * * *